US010633245B2

(12) United States Patent
Clare et al.

(10) Patent No.: US 10,633,245 B2
(45) Date of Patent: Apr. 28, 2020

(54) POCKETED SPRING UNIT AND METHOD AND APPARATUS FOR FORMING THE SAME

(71) Applicant: Harrison Spinks Components Limited, Leeds, West Yorkshire (GB)

(72) Inventors: David Clare, Barnsley (GB); Simon Paul Spinks, Cawood (GB); Richard Essery, Leeds (GB); Michael Gallagher, Leeds (GB)

(73) Assignee: HARRISON SPINKS COMPONENTS LIMITED, Leeds, West Yorkshire (GB)

( * ) Notice: Subject to any disclaimer, the term of this patent is extended or adjusted under 35 U.S.C. 154(b) by 321 days.

(21) Appl. No.: 15/115,460

(22) PCT Filed: Jan. 30, 2015

(86) PCT No.: PCT/GB2015/050236
§ 371 (c)(1),
(2) Date: Jul. 29, 2016

(87) PCT Pub. No.: WO2015/114361
PCT Pub. Date: Aug. 6, 2015

(65) Prior Publication Data

US 2017/0008756 A1 Jan. 12, 2017

(30) Foreign Application Priority Data

Jan. 30, 2014 (GB) ..... 1401606.7

(51) Int. Cl.
*B68G 9/00* (2006.01)
*A47C 27/06* (2006.01)
*B68G 15/00* (2006.01)

(52) U.S. Cl.
CPC ..... *B68G 9/00* (2013.01); *A47C 27/064* (2013.01); *B68G 15/00* (2013.01)

(58) Field of Classification Search
CPC ..... A47C 27/064; B68G 9/00; B68G 15/00
See application file for complete search history.

(56) References Cited

U.S. PATENT DOCUMENTS 6,175,997 B1 * 1/2001 Mossbeck ..... A47C 27/064 156/301

FOREIGN PATENT DOCUMENTS

EP 0089789 A1 9/1983
GB 1586909 A 3/1981
(Continued)

OTHER PUBLICATIONS

Search Report issued in Related GB Patent Application No. 1401606.7 dated Jul. 24, 2014 (3 sheets).
(Continued)

*Primary Examiner* — Vishal I Patel
(74) *Attorney, Agent, or Firm* — Gesmer Updegrove LLP

(57) ABSTRACT

A method of forming a pocketed spring unit for an upholstered article comprises taking successive strings of pocketed springs and welding at least one sheet of material to at least a first end of the pocketed springs. Anvils 46 are moved from a non-operative position to an operative position, in which they are located between adjacent pockets at upper and lower ends of the springs. This embodiment makes use of the surplus material that is formed at the ends of the pockets in the form of flaps or "ears" of material. These flaps protrude upwardly initially, and then become folded flat as the spring unit advances between the rolls 48 of material. The external anvils are then made to apply heat and pressure to the material flaps trapped between them and the internal
(Continued)

Figure 1:
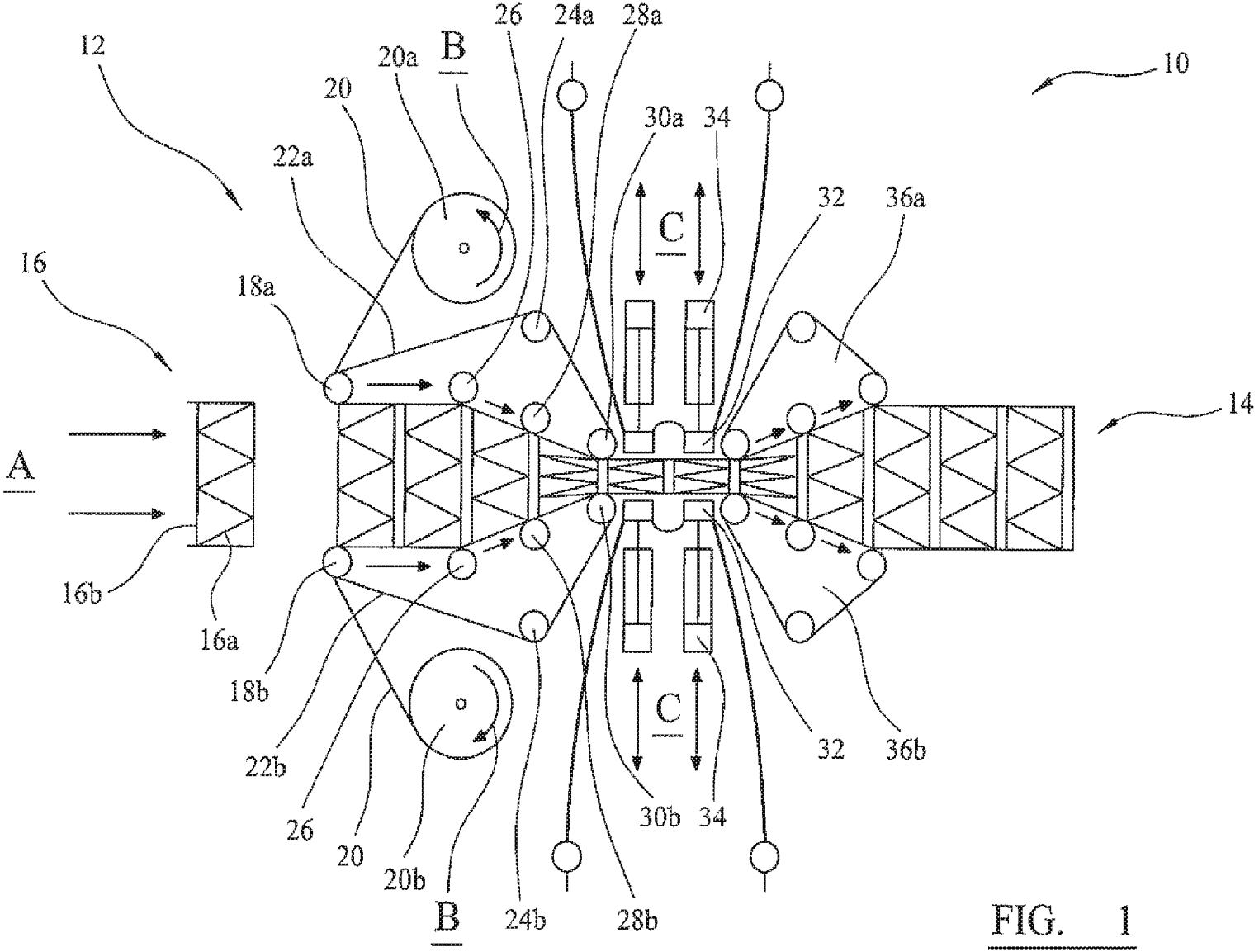

anvils at the sides of the pockets, between the springs to weld them to the material from the rolls 48.

8 Claims, 4 Drawing Sheets

(56) References Cited

FOREIGN PATENT DOCUMENTS

| | | | | |
|---|---|---|---|---|
| WO | WO-0126507 A1 * | 4/2001 | ..... | A47C 27/064 |
| WO | WO-2006043862 A1 * | 4/2006 | ..... | A47C 27/063 |
| WO | 2014113737 A1 | 7/2014 | | |

OTHER PUBLICATIONS

International Search Report and Written Opinion issued by the International Searching Authority in related International Application No. PCT/GB2015/050236 dated Apr. 20, 2015, 10 pages.
International Preliminary Report on Patentability issued by the International Bureau of WIPO in related International Application No. PCT/GB2015/050236 dated Aug. 2, 2016, 7 pages.

* cited by examiner

POCKETED SPRING UNIT AND METHOD AND APPARATUS FOR FORMING THE SAME

PRIORITY INFORMATION

The present invention claims priority to International Patent Application No. PCT/GB2015/050236 filed Jan. 30, 2015, that claims priority to GB Application No. 1401606.7, filed on Jan. 30, 2014, both of which are incorporated herein by reference in their entireties.

The present invention relates to a pocketed spring unit and to a method and an apparatus for forming the same, and is concerned particularly with a pocketed spring unit that is substantially free from adhesive, and to a method and apparatus for forming such a unit.

Pocketed springs, otherwise known as encased springs, are used in upholstered articles such as mattresses. Most pocketed spring units comprise coil springs encased individually in pockets of fabric material formed by folding over a sheet of fabric to form two leaves that envelope the springs, and then attaching the leaves together between the springs so as to form a string of springs. The strings are then joined to form an array of springs as a pocketed spring unit. The joining of the strings together to form an array is achieved either by gluing the strings together along the cylindrical surfaces of the pocketed springs, one string to the next, and so on until the unit is formed, or else by arranging the strings beside each other in the manner of an array, and then gluing sheets of fabric to the cylindrical ends of the pocketed springs, above and below, so as to form the unit.

A problem with either method is the extensive use of glue to hold together the strings, to form the unit. For one thing the adhesive forms a significant element of the cost of manufacturing a pocketed spring unit, and for another the presence of the adhesive in the product makes it difficult to recycle.

Embodiments of the present invention aim to provide a pocketed spring unit, and a method and apparatus for manufacturing the same, in which the shortcomings of the prior art are addressed.

The present invention is defined in the attached independent claims, to which reference should now be made. Further, preferred features may be found in the sub-claims appended thereto.

According to one aspect of the present invention, there is provided a method of forming a pocketed spring unit for an upholstered article, the method comprising taking at least one string of pocketed springs and welding at least one sheet of material to at least a first end of the springs.

Preferably at least some of the springs are compressed axially prior to the step of welding.

In a preferred arrangement at least one welding device is inserted at least partly into at least one pocket prior to the step of welding.

Preferably at least one welding anvil is located at least partly below at least one coil of at least one spring prior to the step of welding.

Preferably at least one welding anvil is located adjacent at least one pocket of at least one spring prior to the step of welding.

Preferably the method comprises indexing the, or each, spring between successive welding steps.

The method may comprise compressing the springs against the sheet of material. In a preferred arrangement the method comprises welding first and second sheets to respective opposed ends of the springs. Preferably the method comprises compressing the springs between the first and second sheets of material.

Preferably the method comprises welding the material by the application of heat or an electric current through the material. The heat or electric current may be applied by heating tools, or anvils or by electrodes at opposed ends of the springs.

The springs may be of conductive metal and where an electric current is used to weld the material the springs may be arranged to conduct the applied welding current.

In a particularly preferred arrangement the method comprises compressing a string of springs substantially simultaneously. The string of springs may be compressed between sheets of material. The method preferably comprises advancing the spring unit so formed step-wise, such that a new string of pocketed springs is introduced at each step-wise advancement, before being compressed and then welded to the sheets of material to become part of the unit. The method may comprise welding the or each sheet of material to one or more flaps formed by surplus pocketing material at locations between adjacent springs.

According to another aspect of the present invention, there is provided apparatus for forming a pocketed spring unit for an upholstered article, the apparatus comprising a welding device for welding at least one sheet of material to at least a first end of the springs.

Preferably the apparatus comprises a compressing device for compressing at least one string of pocketed springs axially.

In a preferred arrangement the welding device is at least partly insertable into at least one pocket prior to the step of welding.

Preferably the welding device is locatable at least partly below at least one coil of at least one spring prior to the step of welding.

Preferably the welding device is locatable adjacent at least one pocket of at least one spring prior to the step of welding.

Preferably the apparatus comprises an indexing device for indexing the, or each, spring between successive welding steps.

The compressing device is preferably arranged in use to compress the springs against the sheet of material. In a preferred arrangement the welding device is arranged to weld first and second sheets to respective opposed ends of the springs. Preferably the compressing device is arranged to compress the springs between the first and second sheets of material.

The welding device may be arranged to weld the material by the application of heat or an electric current through the material. The heat or electric current may be applied by heating tools or anvils or by electrodes at opposed ends of the springs. Where an electric current is used to weld the material, the springs may be of conductive metal and may be arranged to conduct the applied welding current.

In a particularly preferred arrangement the compressing device is arranged to compress a string of springs substantially simultaneously. The apparatus may be arranged to compress the string of springs between sheets of material. The apparatus is preferably arranged to advance the spring unit step-wise, such that a new string of pocketed springs is introduced at each stepwise advancement, before being compressed and then welded to the sheets of material to become part of the unit. The or each sheet of material may be welded to one or more flaps formed by surplus pocketing material at locations between adjacent springs.

The compressing device may comprise one or more rollers and preferably comprises one or more pairs of rollers.

The invention also includes a pocketed spring unit formed by a method or by an apparatus according to any statement herein.

The invention may include any combination of the features or limitations referred to herein, except such a combination of features as are mutually exclusive, or mutually inconsistent.

Figure 2A:
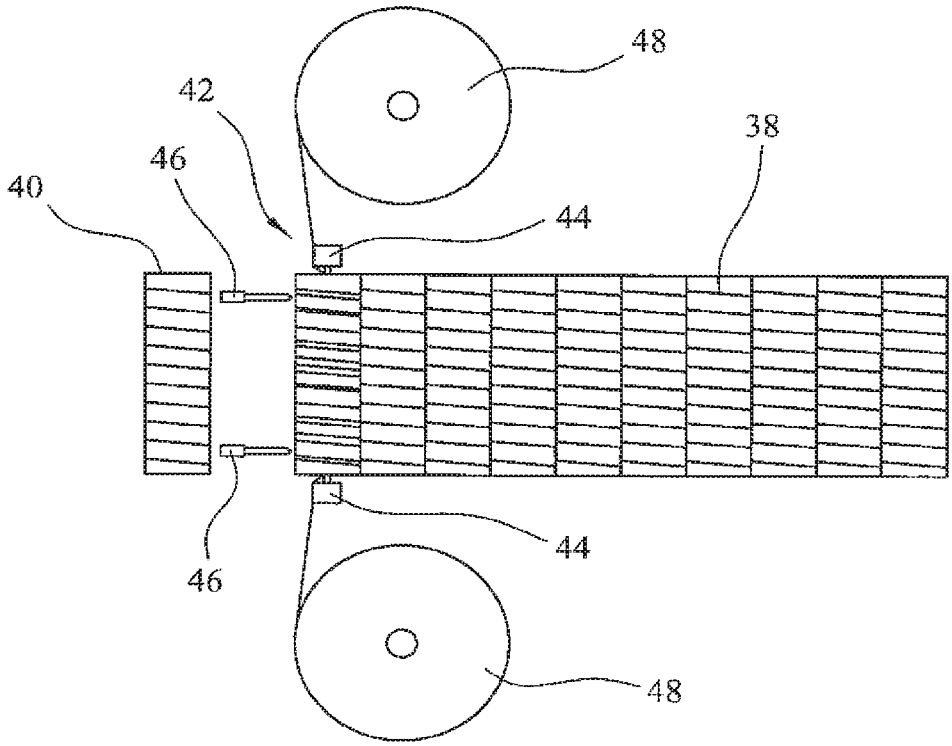
Figure 2B:
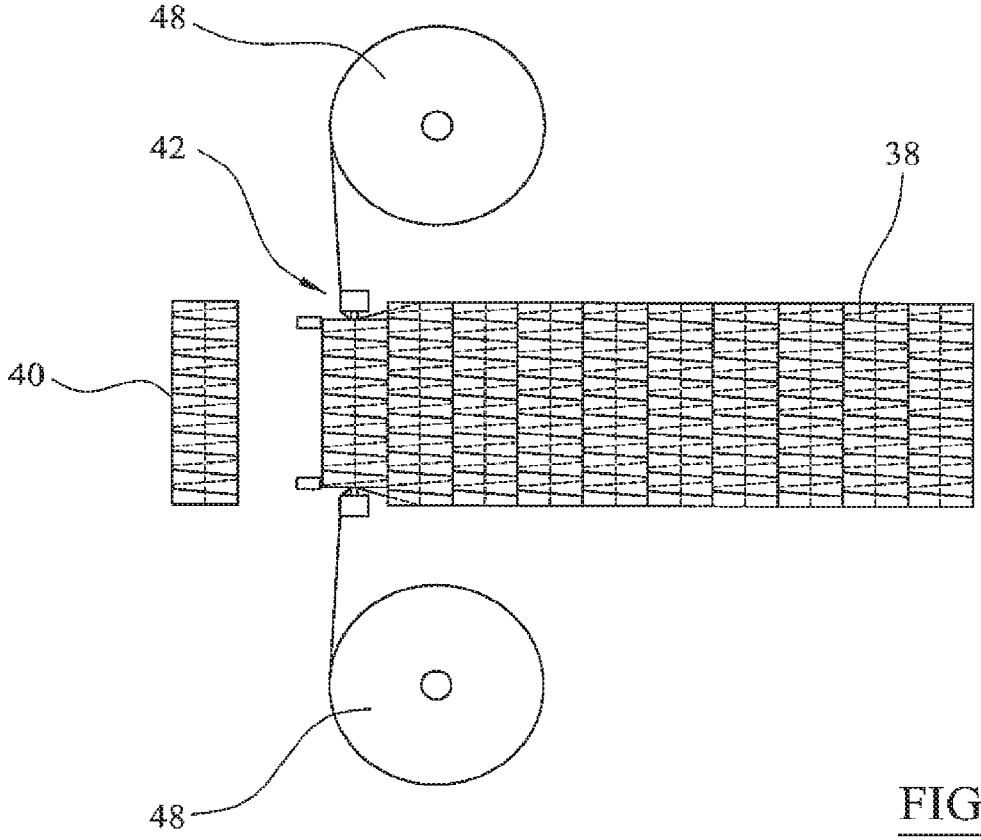
Figure 3C:
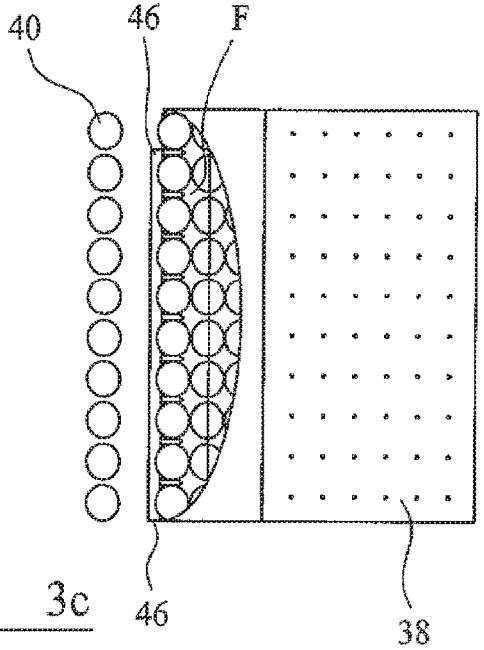
Figure 3D:
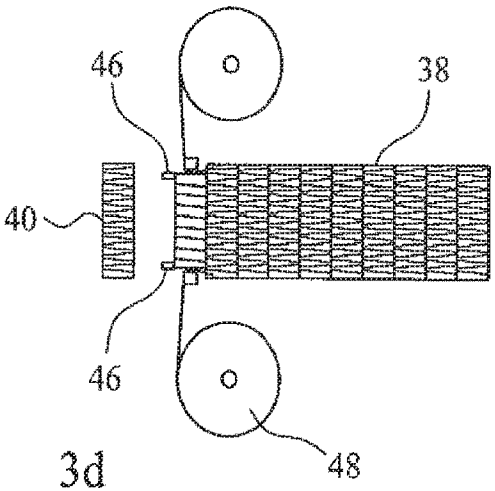
Figure 3E:
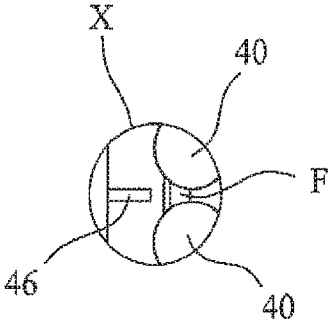
Figure 3A:
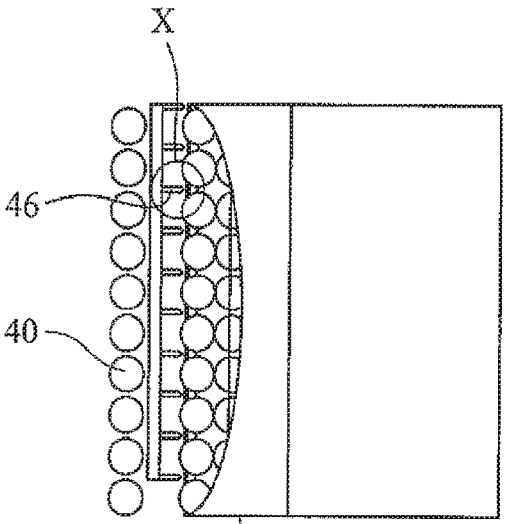
Figure 3B:
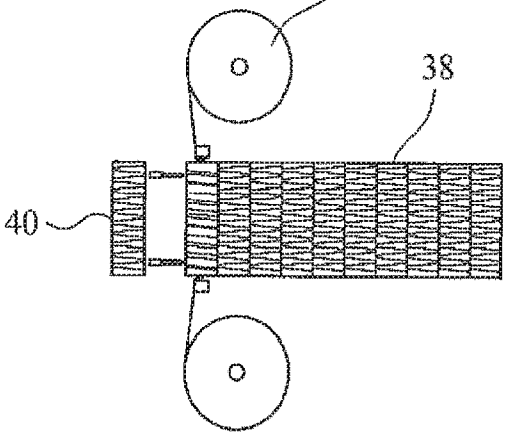
Figure 4A:
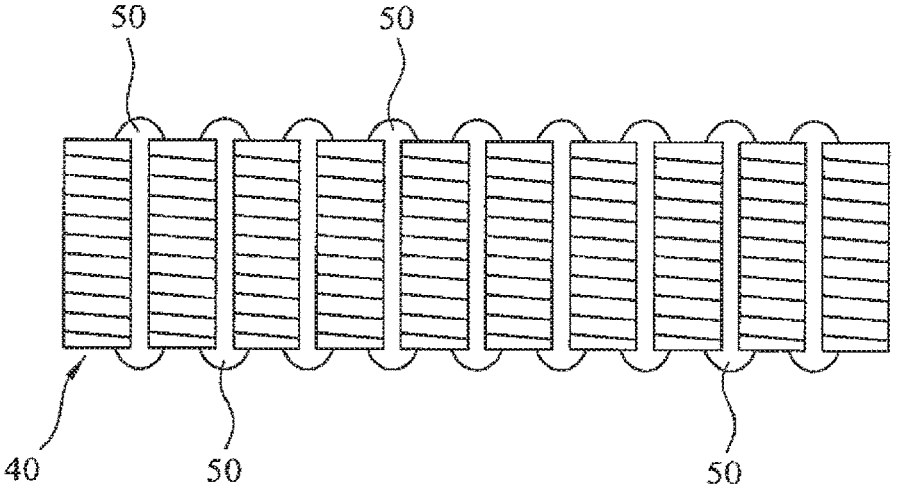
Figure 4B:
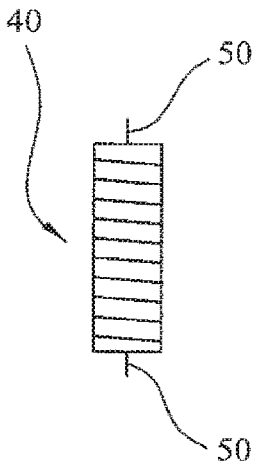
Figure 5:
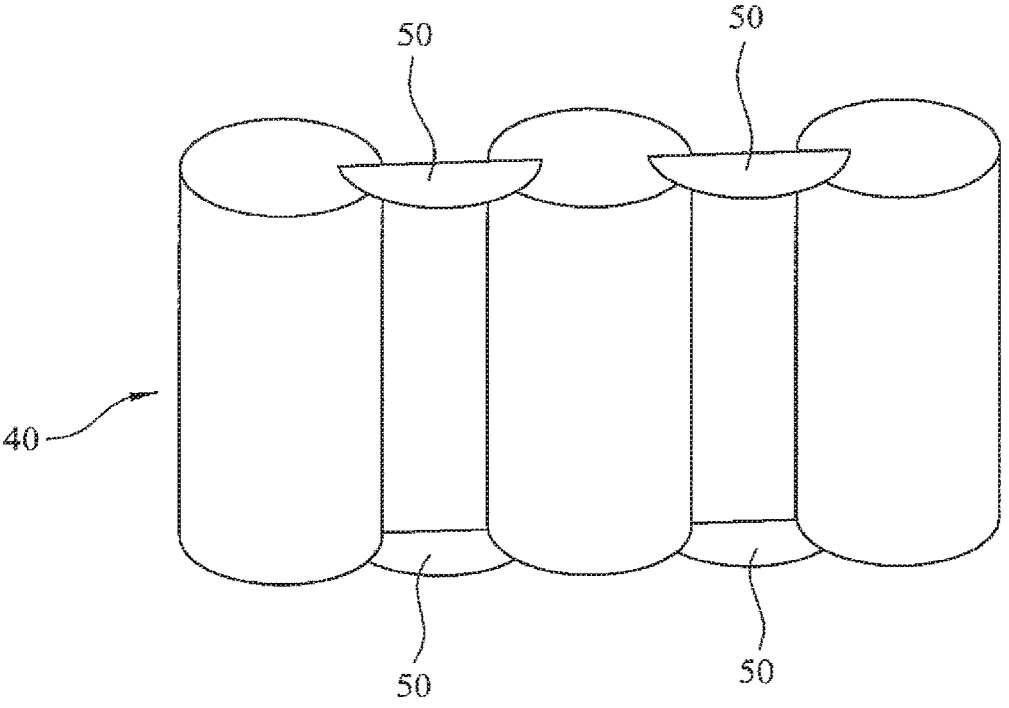

A preferred embodiment of the present invention will now be described. By way of example only, with reference to the accompanying diagrammatic drawings, in which:

FIG. 1 is a schematic side view of an apparatus for forming a pocketed spring unit according to an embodiment of the present invention;

FIGS. 2*a* and 2*b* show schematically an alternative embodiment of apparatus, in accordance with the present invention;

FIGS. 3*a*-3*e* show schematically a further alternative embodiment of apparatus, in accordance with the present invention;

FIGS. 4*a* and 4*b* show, respectively in front view and end view a string of springs, for use in the embodiment of FIGS. 3*a*-3*e*; and FIG. 5 shows a portion of the string of FIGS. 4*a* and 4*b* in more detail.

Turning to FIG. 1, this shows generally at 10 an apparatus for forming a pocketed spring unit, in accordance with a preferred embodiment of the present invention.

The apparatus 10 comprises an input 12 and an output 14. At the input, a string 16 of pocketed springs is shown end-on, so that only the last spring can be seen. Each spring comprises a coil of wire 16*a* inside an individual pocket 16*b* formed of fabric material. The string 16 is fed in the direction of arrows A towards a first set of upper and lower pre-compression rollers, respectively 18*a* and 18*b*. At this point fabric material 20 is introduced above and below the string of springs from fabric rolls 20*a* and 20*b*, which rotate in the direction of arrows B. the material 20 is fed around rollers 18*a* and 18*b* on belts 22*a* and 22*b* which are driven by synchronized respectively drivers 24*a* and 24*b*.

The uncompressed strings 16 abut each other and pass beyond further pairs of rollers 26 before reaching upper and lower pairs of first stage compression rollers 28*a* and 28*b*, and then upper and lower pairs of second stage compression rollers 30*a* and 30*b*, in which the strings 16 of springs are compressed.

After passing through the rollers 30 the springs are substantially fully compressed and at this point the upper and lower rolls of fabric are welded to the fabric of the springs at the cylindrical ends of the springs by heated welding anvils 32 which are driven in and out in a stamping operation by pneumatic cylinders 34 in the direction of arrows C. Pneumatically operated cylinders 34 press the welding anvils together and hold them momentarily whilst heat passes through them causing the fabric 20 to melt and fuse with the fabric of the pockets 16*b* in the strings of springs.

The output 14 of the apparatus 10 comprises upper and lower belt-driven roller stations 36*a* and 36*b* which allow the springs to decompress and return to their natural height. What leaves the output 14 is a fully welded pocketed spring unit 38 which can be made to any length.

FIGS. 2*a* and 2*b* show schematically an alternative embodiment in which the strings of springs are not compressed prior to welding. In FIG. 2*a* a strings 40 of encased, or pocketed, springs are presented to welding apparatus 42 comprising upper and lower rows of external heating anvils 44 and upper and lower rows of internal heating anvils 46. Fabric material is supplied above and below the strings 40 from fabric rolls 48. When a new string 40 is in position, the internal spiked anvils are made to pierce the fabric of the pocketed springs, as can be seen in FIG. 2*b*. The external anvils are then made to apply heat and pressure to the material trapped between them and the internal anvils inside the pockets. The result is that the fabric from the rolls 48 becomes welded to the fabric of the pockets axially above and below the springs. The spring unit 38 is then advanced and a new string 40 is presented for welding.

In FIGS. 3*a* to 3*e* a preferred alternative embodiment is shown schematically. In this embodiment the upper and lower rows of internal anvils 46 are not made to puncture the fabric of the pocketed springs. Instead the anvils 46 are moved from a non-operative position, shown in FIGS. 3*a* and 3*b* respectively in plan and side view, to an operative position, shown in FIGS. 3*c* and 3*d* in which they are located between adjacent pockets at upper and lower ends of the springs. This embodiment makes use of the surplus material that is formed at the ends of the pockets in the form of flaps or "ears" 50 of material. These flaps protrude upwardly initially, and then become folded flat as the spring unit advances between the rolls 48 of material.

The external anvils are then made to apply heat and pressure to the material flaps 50 trapped between them and the internal anvils at the sides of the pockets, between the springs.

FIG. 3*e* is a detailed view of the circle X of FIG. 3*a*, showing the positions of the anvil 46 before it locates between the springs. The result is that the fabric from the rolls 48 becomes welded to the fabric ears 50 of the pockets axially above and below the springs. The spring unit 38 is then advanced and a new string 40 is presented for welding.

FIGS. 4*a* and 4*b* show the flaps of ears 50 of material more clearly. FIG. 5 shows a portion of the string 40 in more detail, so that the flaps 50 can clearly be seen at the upper and lower ends of the string 40.

One advantage of the methods described above is that, because there is no need to glue the centre portions of the pocketed springs to their neighbours, springs of different shapes and geometries may be used in the spring units. For example barrel-shaped springs or conical springs may be used as they are held together at the ends of the pockets which remain substantially flat and suitable for welding to the upper and/or lower joining sheets.

The specific examples given above utilise thermal welding of the material. However, in an alternative embodiment, welding by other means, such as the application of electric current, may be employed. In any event here the term "welding device" or "anvil" or "electrode" is used herein, it is to be taken to include an active or passive device which may actively bring about welding, for example by heat or vibration, or else may passively assist in the welding process, such as by supporting or positioning the material to be welded by contact with another member.

Whilst endeavouring in the foregoing specification to draw attention to those features of the invention believed to be of particular importance, it should be understood that the applicant claims protection in respect of any patentable feature or combination of features referred to herein, and/or shown in the drawings, whether or not particular emphasis has been placed thereon.

The invention claimed is:

1. A method of forming a pocketed spring unit for an upholstered article, the method comprising taking a plurality of strings of pocketed springs and welding at least one cover sheet of material to only one or more flaps formed by surplus pocketing material at locations between adjacent springs on at least a first end of the pocketed springs.

2. A method according to claim 1, wherein one or more of the pocketed springs are compressed axially prior to the step of welding.

3. A method according to claim 1, wherein at least one welding device is any of inserted at least partly into at least one pocket prior to the step of welding, or inserted adjacent to at least one pocket prior to the step of welding.

4. A method according to claim 1, wherein at least one welding anvil is located at least partly below at least one coil of at least one spring prior to the step of welding.

5. A method according to claim 1, wherein the method comprises indexing one or more of the pocketed springs between successive welding steps.

6. A method according to claim 1 wherein the method comprises any of compressing the pocketed springs against the at least one cover sheet of material, or compressing the plurality of strings of the pocketed springs substantially simultaneously, or compressing the pocketed springs between the at least one cover sheet of material and another sheet of material, or compressing the plurality of strings of the pocketed springs between the at least one cover sheet of material and another sheet of material.

7. A method according to claim 1, wherein the method comprises any of welding first and second sheets to respective opposed ends of the springs, or welding the at least one cover sheet of material by applying heat through the at least one cover sheet of material wherein the heat is applied by heating tools at opposed ends of the pocketed springs.

8. A method according to claim 1, wherein the method comprises advancing the pocketed spring unit step-wise, such that a new string of pocketed springs is introduced at each stepwise advancement, before being compressed and then welded to the at least one cover sheet of material to become part of the pocketed spring unit.

* * * * *